United States Patent [19]

Obara

[11] Patent Number: 4,967,232

[45] Date of Patent: Oct. 30, 1990

[54] COPYING APPARATUS WITH CONVEYER FOR CONVEYING ORIGINALS TO PREDETERMINED COPYING POSITION

[75] Inventor: Tsuneo Obara, Kanagawa, Japan

[73] Assignee: Fuji Xerox Co., Ltd., Tokyo, Japan

[21] Appl. No.: 242,991

[22] Filed: Sep. 12, 1988

[51] Int. Cl.[5] ..... G03G 15/28

[52] U.S. Cl. ..... 355/233; 355/235; 355/308; 355/311

[58] Field of Search ..... 355/235, 311, 233, 308, 355/243

[56] References Cited

U.S. PATENT DOCUMENTS

| | | | |
|---|---|---|---|
| 4,708,486 | 11/1987 | Watanabe | 355/233 X |
| 4,739,369 | 4/1988 | Yoshiura et al. | 355/311 X |
| 4,791,451 | 12/1988 | Hirose et al. | 355/311 |
| 4,864,366 | 9/1989 | Saeki | 355/308 X |

*Primary Examiner*—A. T. Grimley
*Assistant Examiner*—Thu A. Dang
*Attorney, Agent, or Firm*—Finnegan, Henderson, Farabow, Garrett, and Dunner

[57] ABSTRACT

A copying apparatus includes an automatic original conveyer, an original size detection sensor, a scanning optical system for transferring an image from an original to a photosensitive element, and a control portion for transmitting electrical command signals to the separate elements and control operation of the conveyer in accordance with an operaional program. When a smaller-size original is detected by the size detection sensor, control signals are generated to the conveyer which shorten the conveying distance and reduce the exchange time so as to copy smaller size originals more rapidly, thereby significantly improving the productivity of the copier over the prior art.

7 Claims, 9 Drawing Sheets

COPYING APPARATUS WITH CONVEYER FOR CONVEYING ORIGINALS TO PREDETERMINED COPYING POSITION

BACKGROUND OF THE INVENTION

1. Field of the Invention

The present invention relates to a photocopying apparatus, and particularly relates to such a copying apparatus provided with an automatic original conveyer for automatically conveying an original to a predetermined copying position.

2. Description of the Prior Art

When a large number of originals are to be photocopied at one time, a large burden is imposed on an operator. To make such copying work efficient, an automatic original conveyer has been used. An example of the automatic original conveyer will be described with reference to FIGS. 10–12.

In FIG. 10, an automatic original conveyer 10 includes an original tray 12 for receiving originals 11 therein, an original conveying portion 13 for conveying the original 11 fed from the original tray 12 to a copying position, an original conveying belt 16, and an original discharging roller 17.

The automatic original conveyer 10 is mounted on an upper glass surface 20. Scanning optical systems 21 and 22 for copying a picture carried by the original 11 are disposed under the glass surface 20. The scanning optical system 21 includes a lamp **21*a* and a mirror 21*b* so as to plane-scan the original 11 in the direction of an arrow 14 of FIG. 10 by the so-called "full-scanning". The scanning optical system 22, on the other hand, includes two mirrors 22*a* and 22*b* for scanning the original 11 in the direction of the arrow 14** by the so-called "half-scanning".

If copying is started with the originals 11 placed in the original tray 12 in the thus arranged automatic original conveyer 10, the first original 11 is fed between the glass surface 20 and the original conveying belt 16 through the original conveying portion 13. The original 11 is delayed at a gate 15 immediately before the original conveying belt 16. As soon as the gate 15 is opened, the original conveying belt 16 commences to be driven.

The original conveying belt 16 is driven for a predetermined period of time after the gate 15 has been opened so as to convey the original 11 to a copying position along the upper surface of the glass surface 20. Upon completion of conveyance of the original 11, the scanning optical systems 21 and 22 start scanning so as to perform copying. Upon completion of copying, the original conveying belt 16 conveys the original 11 to the discharging roller 17. Simultaneously with the discharge of the original 11, a succeeding original 11 is conveyed from the original tray 12 to the copying position.

By repetition of the operation as described above, the originals are successively conveyed one after another onto the glass surface 20 so that successive copying of those originals is carried out continuously and automatically.

The foregoing automatic original conveyer 10 can convey originals of various sizes.

In FIG. 11, an original **1*a* having a size, for example, of 11 ×14 inches has been fed into a predetermined copying position on the glass surface 20. In this case, the original 1*a* is conveyed along a path shown by line 2 of FIG. 11, and stopped at the predetermined copying position so that the forward end of the original 1*a* comes on a fixed reference line 51**.

Here, the scanning optical system (in this case, it is assumed that the same scanning optical system 21 for performing full-scanning in FIG. 10 is used) performs scanning along a lower surface of the glass surface 20 from the left end to the right end as shown by arrow 3 in FIG. 11, and returns to an original position after completion of scanning. For example, when copying of a plurality of sheets is required, each sheet is scanned in direction **3*a* and returned in direction 3*b*. This process is repeated several times as shown in FIG. 11**.

If an 8×11 inch original **1*b* is copied by using the same automatic original conveyer 10 as shown in FIG. 12, the original 1*b* is conveyed onto the glass surface 20 as shown by arrow 2 in FIG. 12, and stopped at a predetermined copying position so that the forward end of the orginal 1*b* comes on the fixed reference line 51, in the same manner as the foregoing case of FIG. 11. The respective forward ends of the original 1*a* having a size of 11×14 inches in FIG. 11 and the original 1*b* having a size of 8½×11 inches in FIG. 12** come on the same position.

In the case of FIG. 12, the scanning optical system performs scanning along the lower surface of the glass surface 20 from the left end to the right end of the original **1*b* as shown by an arrow 3' of FIG. 12 so as to repeat scanning in direction 3'*a* and returning in direction 3'*b* which are shorter than the scanning direction 3*a* and returning direction 3*b* in the case of FIG. 11**.

In a copying apparatus in which copying of such a large number of originals is carried out at a high speed, a belt-like photosensitive element 25, for example, as shown in FIG. 13 is used. The belt-like photosensitive element 25 is guided by three guide rollers 26 so as to be always conveyed in the direction of an arrow **25*a* of FIG. 13**. The effect is similar to an endless belt at a predetermined speed during a copying operation.

Generally, such a belt-like photosensitive element 25 has a seam portion **25*b*. Accordingly, an electrostatic latent image forming position is generally provided on the belt-like photosensitive element 25 so as to perform exposure while avoiding the seam port 25*b* because a normal electrostatic latent image cannot be formed on the seam portion 25*b* even if exposure is performed on the seam portion 25*b*. In this case, a reference mark 25*c* is put, for example, in the vicinity of the seam portion 25*b* of the photosensitive element 25, and exposure is started from a position shown by an arrow 19 at a predetermined timing after detection of the reference mark 25*c* by a reference mark sensor 25*d***.

Now, assume that the photosensitive element 25 is developed after separation at the seam portion **25*b*, for example, as shown in FIG. 14. Then, two electrostatic latent images 25*e* each forced upon exposure of an 11×14 inch original are obtained as illustrated in the drawing. Assuming that the photosensitive element 25 is being conveyed in the direction of an arrow 25*a* of FIG. 14, scanning 1 over the portion of the right electrostatic latent image 25*e* is carried out by the scanning optical system described above. The scanning optical system returns at the portion between the two electrostatic latent images 25*e*, while the next original is conveyed to the predetermined copying position in this period. Then, scanning 2** is carried out.

Here, when the cases of FIGS. 11 and 12 are compared with each other again, an original conveying distance of FIG. 11 is equal to that of FIG. 12 as shown by the arrows 2 although the size of the original 1*a* of FIG. 11 is different from that of the original 1*b* of FIG. 12. Therefore, in the automatic original conveyer, time taken for feeding an original from the original tray into the predetermined copying position in the case of FIG. 11 is equal to that in the case of FIG. 12.

In FIG. 14, in the period from termination of the scanning 1 to start of the scanning 2, the scanning optical system is returned, the original which has been copied is discharged, and the succeeding original is fed into the copying position.

Actually, scanning of the scanning optical system is started after the succeeding original has been fed into the predetermined copying position because return of the scanning optical system can be completed generally at a relatively high speed.

In so-called continuous copying in which one and the same original is repeatedly copied, on the other hand, the scanning optical system can perform scanning in a shorter period because a waiting period for conveying an original is omitted. If the length of the photosensitive element 25 and existence of the seam portion 25*b* are taken into consideration, however, the allotment of latent images is limited to that as shown in FIG. 14, with respect to an 11×14 inch original.

FIG. 15 shows an example of spaced electrostatic latent image forming positions with respect to an 8½×11 inch original.

On the assumption that continuous copying is carried out at a short scanning distance as shown in FIG. 12, the spacing of FIG. 15 is selected so that the copying can be performed at the highest speed possible. In this case, electrostatic latent images 25*e* are formed at four positions corresponding to the respective scanning 1, scanning 2, scanning 3, and scanning 4, so that four copies should be obtained in every one complete revolution of the photosensitive element 25.

In the case where the original which has been copied is discharged after the scanning 1, and the succeeding original is conveyed, however, the time required for exchanging 1 as shown in FIG. 15 results in a loss of the timing for starting the scanning 2. Generally, since the scanning sequence of the scanning optical system is fixed at the point when the size of an original is detected, it is difficult to delay the starting timing of the scanning 2 to be synchronous with the timing of the exchanging 1. Consequently, after the exchanging 1, the starting of the scanning 3 is performed, by passing the sequence of scanning 2.

The scanning 4 should commence after the scanning 3 in the case of continuous copying. If the original exchanging 2 is performed here, however, the sequence of the scanning 4 is bypassed, and the start of scanning 1 is performed.

That is, although four copies can be obtained in every one complete revolution of the photosensitive element in continuous copying, only two copies can be obtained in every one complete revolution of the photosensitive element in the case where originals are exchanged every time copying is made.

This is because of the long time required for exchanging originals. As a result, there has been a disadvantage in that the productivity of the scanning optical system is reduced by half despite the difference between the time for returning of the scanning optical system and the time for exchanging originals being very small.

It is necessary to increase the conveying speed of the automatic original conveyer in order to solve the foregoing problem. However, an increase in conveying speed causes various problems which thereby increase the cost.

Further, although a change in the scanning sequence when originals are exchanged has been considered, no significant improvement is obtained because the copying operation is made more complicated. The change of the scanning sequence is therefore not practical.

It is therefore an object of the present invention to eliminate the foregoing disadvantages in the prior art.

It is another object of the present invention to provide a copying apparatus in which productivity can be improved without increasing the original conveying speed of an automatic original conveyer.

Additional objects and advantages of the invention will be set forth in the description which follows, and in part will be obvious from the description, or may be learned by practice of the invention. The objects and advantages of the invention may be realized and obtained by means of the instrumentalities and combination particularly pointed out in the claims.

SUMMARY OF THE INVENTION

In order to attain the above objects, according to the present invention, the copying apparatus comprises: an automatic original conveyer means for automatically feeding an original into a predetermined copying position; an original-size detection means for detecting a size of the original prior to feeding of the original into the predetermined copying position; a copying means; a copying position selection means for selecting one of at least two preliminarily set copying positions, in accordance with the size of the original detected by the original-size detection means; and a control means for preliminarily setting at least two scanning regions corresponding to the at least two copying positions and for selecting one of the at least two scanning regions corresponding to the selected copying position to thereby drive a scanning optical system in the selected scanning region.

In the thus arranged copying apparatus, the original conveying distance is shortened when the size of an original is small while the original conveying distance is kept long without change from the conventional case when the size of an original is large. That is, an original of a small size is stopped at a position prior to the copying position of a large-sized original, and the position is set as a copying position for the small-sized original, whereby the original exchanging time is shortened so as to improve productivity of the copying apparatus.

BRIEF DESCRIPTION OF THE DRAWINGS

The accompanying drawings, which are incorporated in and constitute a part of the specification, illustrate a preferred embodiment of the invention, and together with the general description given above and the detailed description of the preferred embodiment given below, serve to explain the principles of the invention.

DETAILED DESCRIPTION OF THE PREFERRED EMBODIMENT

Reference will now be made in detail to the present preferred embodiment of the invention as illustrated in the accompanying drawings.

Figure 1:
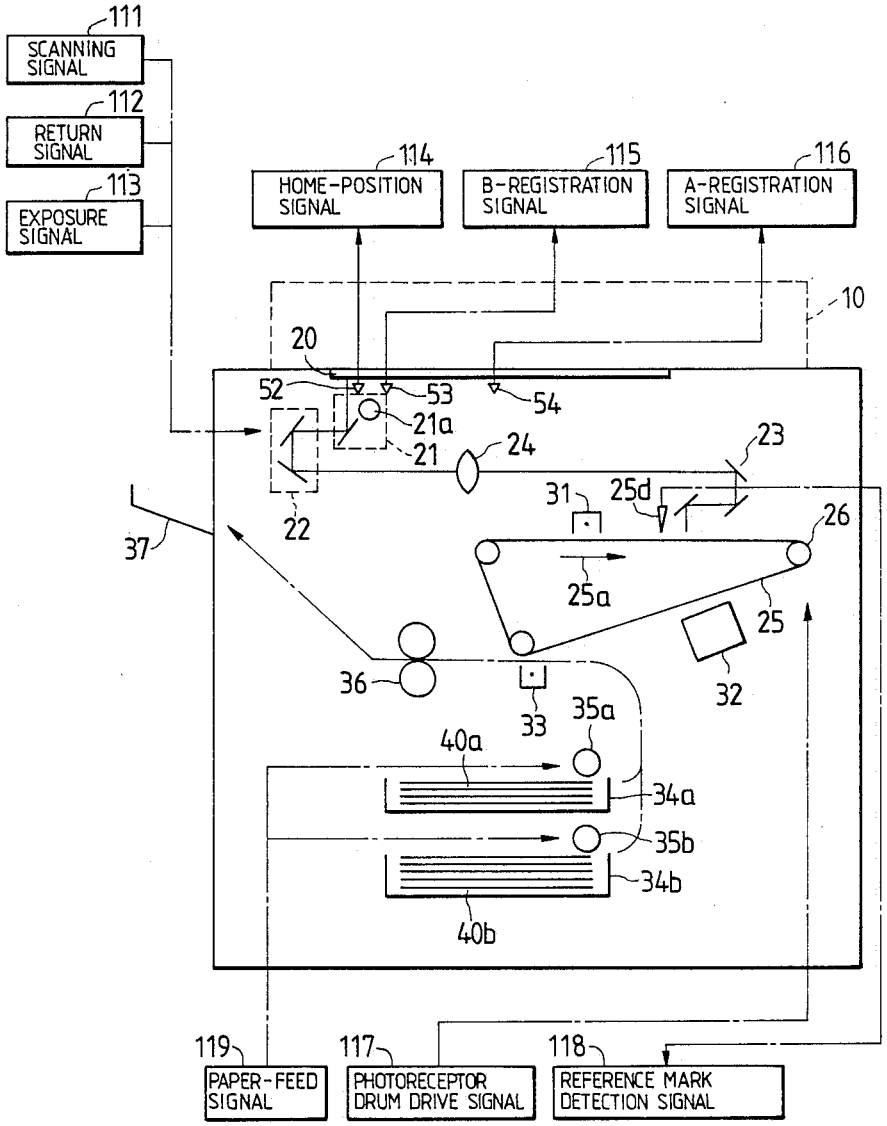
FIG. 1 is a schematic diagram showing an embodiment of the copying apparatus according to the present invention.

FIG. 1 is a block diagram schematically showing an embodiment of the copying apparatus according to the present invention.

Prior to description of the copying apparatus according to the present invention, the arrangement of the automatic original conveyer attached to the copying apparatus will be described with reference to FIG. 2.

An automatic original conveyer 10 includes an original tray 12 in which originals 11 are received, an original conveying portion 13, an original conveying belt 16, and original discharging rollers 17.

The original conveying portion 13 includes a paddle feeder **13*a* for drawing out the originals 11, conveying rollers 13*b*, oblique rollers 13*c*, pinch rollers 13*e*, a direction changing pawl 13*f*, and reverse-feed rollers 13*g***.

The original conveying portion 13 is provided with an original-size detection means 18, an original-side registration detection means **13*d*, and a gate 15**.

The paddle feeder **13*a* is formed of a soft plastic material in the shape of a propeller, and arranged to rotate so as to draw out the uppermost one of the stack of originals 11 and insert the original 11 between the conveying rollers 13*b*. Further, the conveying rollers 13*b*, the oblique rollers 13*c*, the pinch rollers 13*e*, and the reverse-feed rollers 13*g* are respectively arranged in sequence so that each roller pair rotates at a predetermined timing independently of the other roller pairs so as to insert the original 11** therebetween and convey the same to the next stage.

Figure 2:
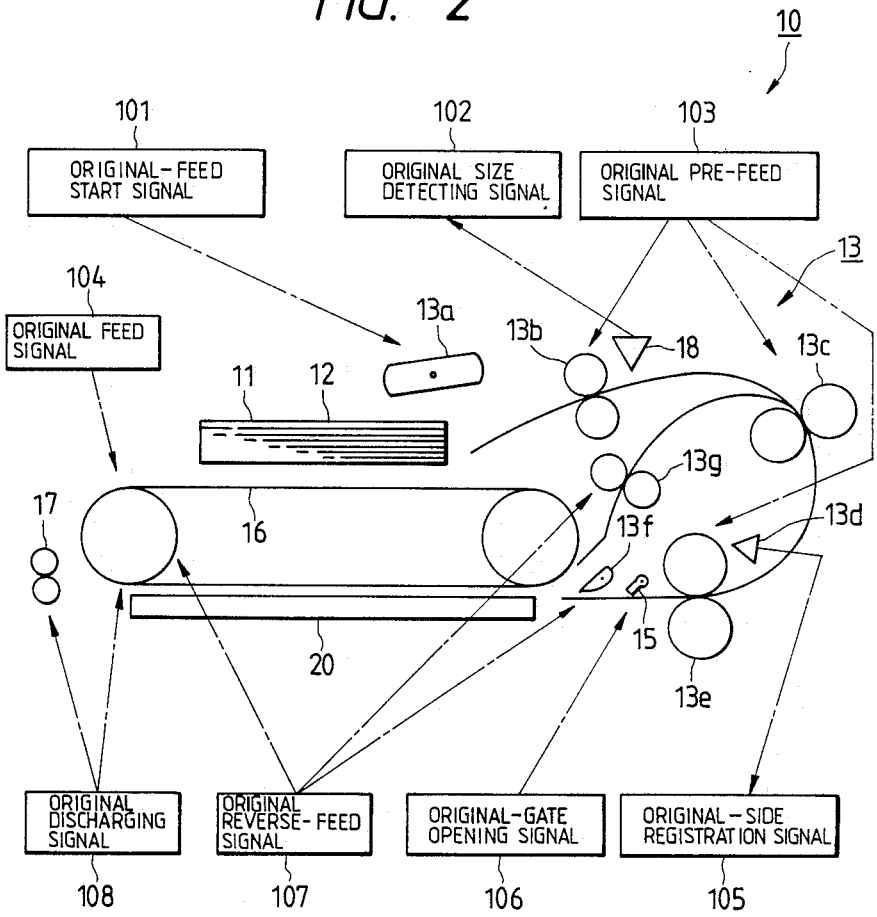
FIG. 2 is a schematic diagram of an automatic original conveyer used in the copying apparatus of FIG. 1.

Various signals shown in FIG. 2 are supplied or produced from the apparatus 10 so as to control the apparatus 10 as follows.

An original-feed start signal 101 is supplied to the paddle feeder **13*a* so as to drive the paddle feeder 13*a* to rotate, thereby drawing out the uppermost one of the originals 11 from the original tray 12. Actually, the signal 101 is supplied to the paddle feeder 13*a* before the original-size detection means 18 detects a front end of the original 11**.

An original-size detection signal 102 is produced from the original-size detection means 18 so as to obtain the length of the original 11 in the conveying direction as a function of the amount of time required for the passage of original 11 and a conveying speed of the same. The orginal-size detection means 18 is constituted by a light reflection type sensor and one for producing a detection signal which is changed from "ON" to "OFF", for example, when the original 11 passes by. The size of the original 11 is obtained through calculation by using the detection signal.

An original pre-feed signal 103 is supplied to the conveying rollers **13*b* and the oblique rollers 13*c* so as to convey the original 11 to the gate 15 after start of conveying. The signal 103 is used to drive the conveying rollers 13*b* and the oblique rollers 13*c*. The supply of the original pre-feed signal 103 to the rollers 13*b* and 13*c* continues until detection of the forward end of the original 11 by the original-side registration sensor 13*d*. The conveying rollers 13*b* open to release the original 11 to make the conveying force vanish after the forward end of the original 11 has reached the original side registration sensor 13*d***.

An original-side registration signal 105 is produced from the original-side registration sensor **13*d* so as to detect arrival of the forward end of the original at the gate 15. The original-side registration sensor 13*d* is comprised of a light reflection type sensor and so on, and the detection signal of the sensor 13*d* is changed from "ON" to "OFF", for example, upon detection of the original 11**.

An original-gate opening signal 106 is supplied to the gate so that the original 11, the forward end of which has reached the gate 15 is conveyed toward the original conveying belt 16 in accordance with a predetermined timing. When the gate 15 is opened in response to the signal 106, the original 11 is fed between the original conveying belt 16 and a glass surface 20 by a conveying force of the pinch rollers **13*e***.

An original feed signal 104 is supplied to the original conveying belt 16. The signal 104 is supplied to a driving motor of the original conveying belt 16 continuously during a period from opening of the gate 15 to stoppage of the original 11 at a predetermined copying position. The time of supply of the signal 104 is accurately calculated in advance on the basis of the original paper size. In this embodiment of the present invention, two separate timing functions are used. The proper function is selected in accordance with the original paper size.

If only one side of the original 11 is to be copied, an original discharging signal 108 is supplied to the original conveying belt 16 and the discharging rollers 17 so that the original 11 disposed at a copying position on the glass surface 20 is discharged upon completion of copying of the original 11. When the original 11 has been conveyed by the original conveying belt 16 to reach the original discharging rollers 17 at its forward end, the original discharging rollers 17 discharge the original 1 from the glass surface 20 even though the original conveying belt 16 stops conveying of the original 11 thereafter.

When both sides of the original 11 are to be copied, an original reverse-feed signal 107 is supplied to the original conveying belt 16, the changing pawl **13*f*, and the reverse-feed rollers 13*g*. The signals result in the original 11 on the glass surface 20 being turned over and reconveyed toward the gate 15. If the original conveying belt 16 has sent out the back end of the original 11 properly, the direction of the changing pawl 13***f* is changed to thereby guide the original 11 toward the reverse-feed rollers 13*g*. The reverse-feed rollers 13*g* convey the back end of the original 11 to the oblique rollers 13*c*, and then release it. Thus, the back end of the original 11 is treated as if it is the forward end of the same, and reconveyed to the gate 15 by the oblique rollers 13*c*. The subsequent operation is the same as that described above.

Returning to FIG. 1, the arrangement of the copying portion of the apparatus will be described.

In the apparatus, a scanning optical system 21 for performing full-scanning, a scanning optical system 22 for performing half-scanning, a lens 24, and a position-fixed imaging optical system 23 are provided under the glass surface 20 so as to transfer a picture carried by an original onto a photosensitive element 25. A home-position sensor 52, a B-registration sensor 53, and an A-registration sensor 54 are provided so as to detect the position of the scanning optical system 21 for full-scanning. Each of those sensors is comprised of an optical sensor, a limit switch, or the like, which is turned on/off when the scanning optical system 21 passes by the sensor.

Further, an electrostatic charger unit 31, a developer unit 32, a transfer unit 33, etc., are provided at the outer circumference of the photosensitive element 25. Stacks of copy paper 40*a* and 40*b* are received in paper feed trays 34*a* and 34*b*. The copying paper 40*a* or 40*b* is fed out of the paper feed tray 34*a* or 34*b* by a paper feed roller 35*a* or 35*b*, passed by the transfer unit 33, and discharged to a discharge tray 37 through a fixing unit 36.

As shown in FIG. 1, various kinds of signals are supplied to or produced from the apparatus so as to control the apparatus.

First, when an original has been set at a predetermined copying position on the glass surface 20, a scanning signal 111 for performing scanning is supplied to the scanning optical systems 21 and 22. The scanning optical systems 21 and 22 start to scan in response to the signal 111. At that time, a home position signal 114 is being produced from the home-position sensor 52. A B-registration signal 115 or an A-registration signal 116 is used to provide a timing for producing an exposure signal 113 or a timing for producing a paper-feed signal 119, after start of scanning. Upon generation of the exposure signal 113, a lamp 21*a* is turned on.

The supply of the scanning signal 111 is continued before the scanning optical system 21 has been moved by a distance corresponding to the size of the original. Thereafter, when a return signal 112 is supplied to the scanning optical systems 21 and 22, the scanning optical systems 21 and 22 start to return to their home positions respectively.

Figure 13:
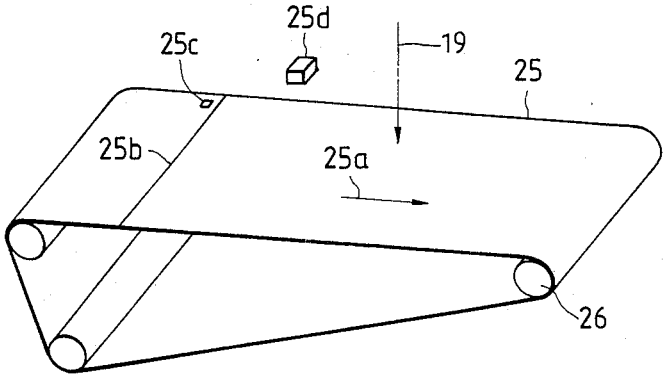
FIG. 13 is a perspective view of a photosensitive element in the copying apparatus according to the present invention.

Upon application of a photoreceptor drum drive signal 117, the drive circuit of the photosensitive element 25 is actuated to convey the photosensitive element 25 in the direction shown by an arrow 25*a* always at a constant speed. A reference mark detection signal 118 is produced from a reference mark sensor 25*d* when the sensor 25*d* detects a reference mark 25*c* formed on the photosensitive element 25 as shown in FIG. 13.

The paper-feed signal 119 is supplied to the feed roller 35*a* or 35*b* at a predetermined timing in accordance to the size of the original. In response to the paper-feed signal 119, the copying paper 40*a* or 40*b* is fed out of the paper-feed tray 34*a* or 34*b*.

Figure 3:
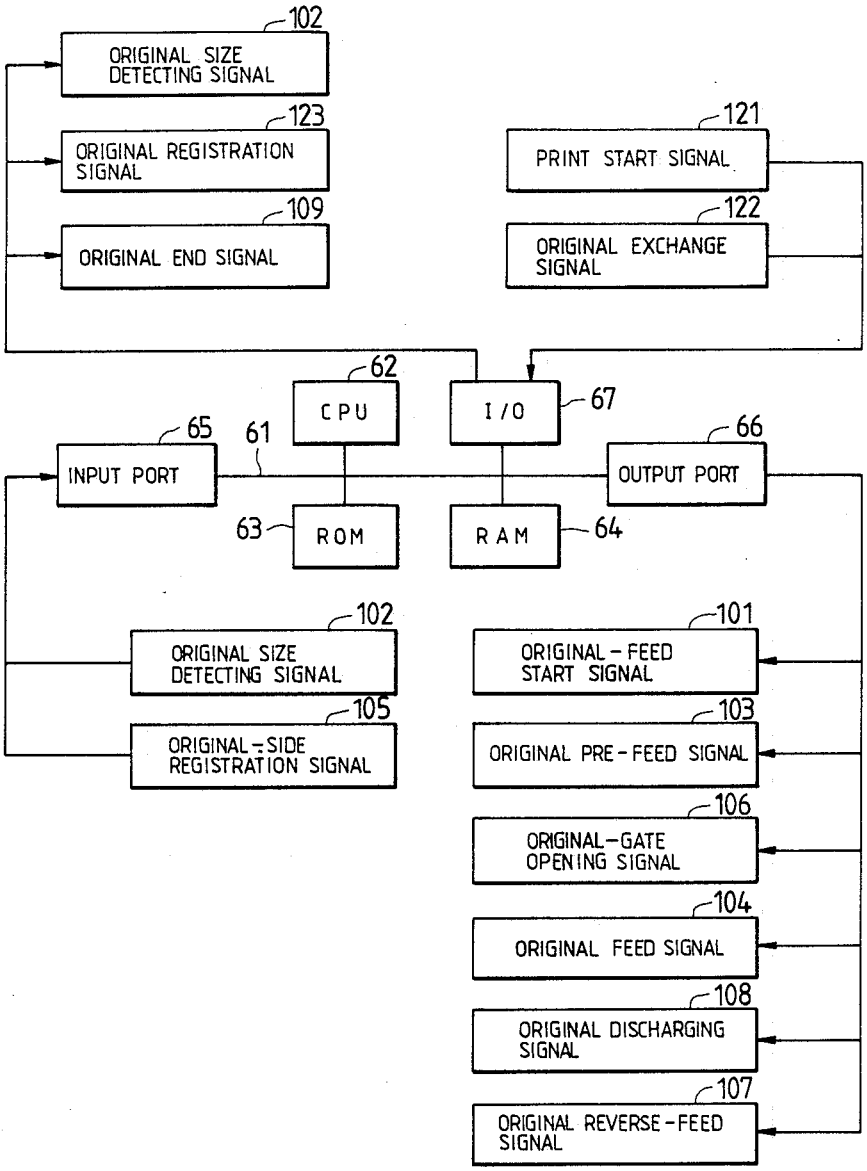
FIG. 3 is a block diagram of a control portion of the automatic original conveyer of FIG. 2.

FIG. 3 is a block diagram of a control portion for controlling the operation of the automatic original conveyer in FIG. 2.

The control portion is provided in the automatic original conveyer and comprised of a central processing unit (CPU) 62 connected to a bus line 61, a read-only memory (ROM) 63, a random access memory (RAM) 64, an input port 65, an output port 66, and an I/O interface 67.

The CPU 62 is a circuit for controlling various portions in the automatic original conveyer and is arranged to perform controlling operation in accordance with an operational program stored in the ROM 63. The RAM 64 is a memory for temporarily storing parameters and other data.

The original-size detecting signal 102 and the original-side registration signal 105 which have been described above with respect to FIG. 2 are applied to the input port 65. The original-feed start signal 101, the original pre-feed signal 103, the original-gate opening signal 106, the original feed signal 104, the original discharging signal 108, and the original reverse-feed signal 107 are produced from the output port 66.

The I/O interface 67 is a circuit for performing signal exchange between the copying apparatus and the automatic original conveyer. The original-size detecting signal 102, the original registration signal 123, and an original end signal 109 are sent out from the I/O interface 67. On the other hand, a print start signal 121 and an original exchange signal 122 are applied from the copying apparatus to the I/O interface 67.

The CPU 62 operates to perform processing such as predetermined calculation, etc., on the basis of the signals applied from the input port 65 and the I/O interface 67 to thereby produce predetermined signals to the output port 66 and the I/O interface 67. This circuit is referred to herein as copying position selection means.

Figure 4:
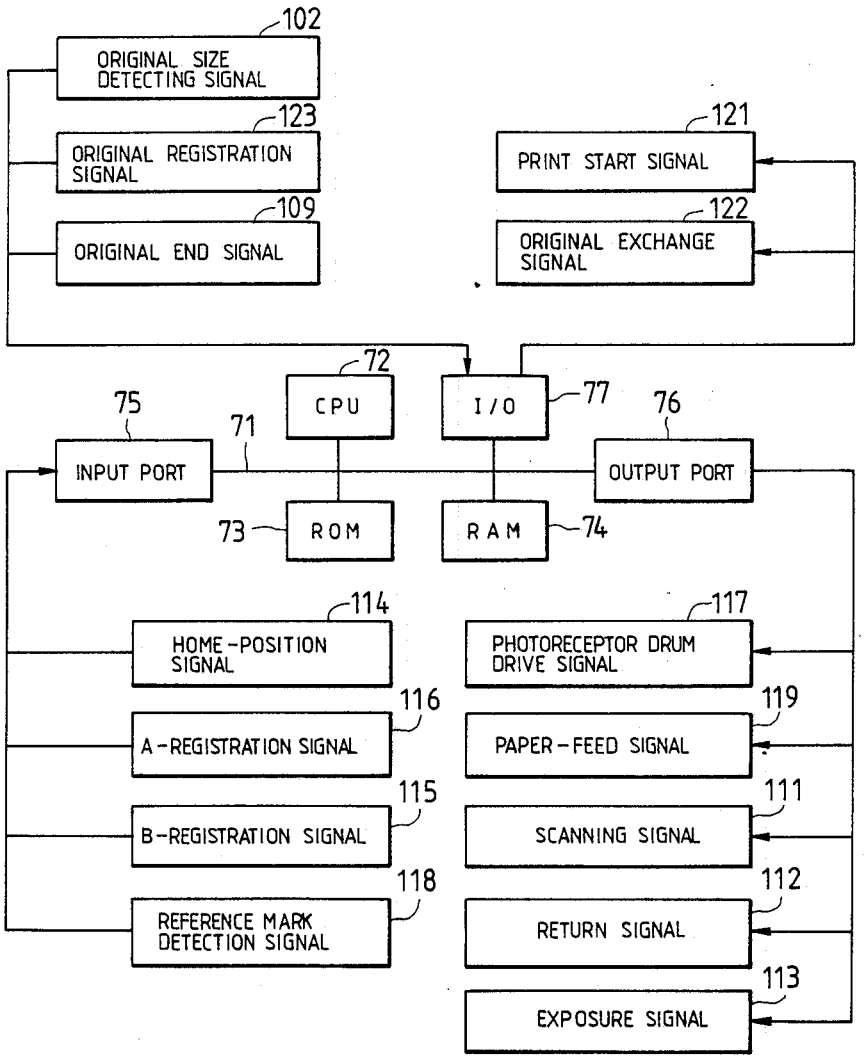
FIG. 4 is a block diagram of a control portion of the copying apparatus of FIG. 1.

FIG. 4 is a block diagram of a control portion for controlling the operation of the copying apparatus in FIG. 1.

The control portion is provided in the copying apparatus and comprised of a central processing unit (CPU) 72 connected to a bus line 71, a read-only memory (ROM) 73, a random access memory (RAM) 74, an input port 75, an output port 76, and an I/0 interface 77.

The CPU 72 is a circuit for controlling various portions in the copying apparatus and is arranged to perform controlling operation in accordance with an operational program stored in the ROM 73. The RAM 74 is a memory for temporarily storing parameters and other data.

The home-position signal 114, the A-registration signal 116, the B-registration signal 115, and the reference mark detection signal 118 which have been described with respect to FIG. 1 are applied to the input port 75. The photoreceptor drum drive signal 117, the paper feed signal 119, the scanning signal 111, the return signal 112, and the exposing signal 113 are sent out from the output port 76.

The I/O interface 77 is a circuit for performing signal exchange between the copying apparatus and the automatic original conveyer. The original-size detecting signal 102, the original registration signal 123, and an original end signal 109 are applied to the I/O interface 77. On the other hand, the print start signal 121 and the original exchange signal 122 are sent out to the automatic original conveyer from the I/O interface 77.

The CPU 72 operates to perform processing such as predetermined calculation, etc., on the basis of the signals applied from the input port 75 and the I/O interface 77 to thereby produce predetermined signals to the output port 76 and the I/O interface 77. This circuit is referred to herein as an optical-system-region selection means.

Figure 5:
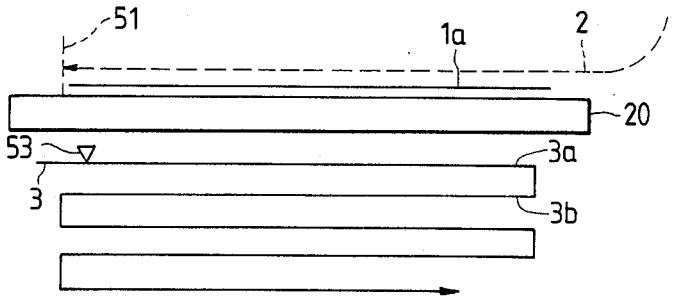
FIGS. 5 and 6 are views for explaining the principle of the present invention.
Figure 6:
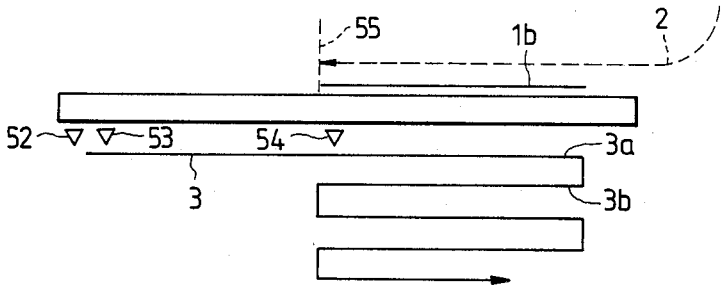

Referring to FIGS. 5 and 6, the operational principle of the copying apparatus according to the present invention will be described. FIGS. 5 and 6 show the originals 1*a* and 1*b* fed onto the glass surface 20 respectively.

In FIG. 5, it is assumed that the original 1*a* has a relatively large size, for example, 11×14. In this case, the original 1*a* is conveyed as shown by an arrow 2 and stopped at a copying position where the forward end of the original 1*a* has reached a reference line 51.

Figure 14:
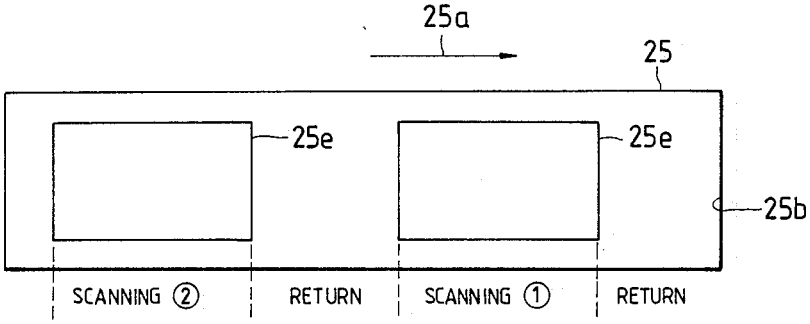
FIGS. 14 and 15 are views explaining the method of providing electrostatic latent images on the photosensitive element according to the present invention.

The scanning optical systems scan the glass surface 20 substantially from its left end to its right end as shown by an arrow 3, in response to the size of the original 1*a*, so as to expose the original la to thereby carry out copying. The scanning range is determined by the CPU 72 shown in FIG. 4 so that the scanning optical systems 21 and 22 (FIG. 1) are accurately reciprocated by forward and reverse rotation of a servo motor, or the like. The scanning signal 111 (FIG. 1) is being produced during scanning in the direction 3*a* in the drawing, while the return signal 112 (FIG. 1) is being produced while returning in the direction 3*b* in the drawing. In this case, the B-registration signal 115 produced from the B-registration sensor 53 is used for providing the timing for generation of the exposing signal 113 (FIG. 1). The placement of electrostatic latent images on the photosensitive element 25 (FIG. 1) in this case is not different from that in the case shown in FIG. 14, and the so-called productivity is not different from that of the conventional copying apparatus.

In FIG. 6, on the other hand, it is assumed that the original 1*b* has a size smaller than that in FIG. 5, for example, 8½×11 inches. Because the effect of the present invention can be obtained in the case of such a smaller original, this case will be described.

In this case, the original 1*b* is conveyed as shown by an arrow 2 and stopped at a copying position where the forward end of the original 1*b* has reached a reference line 55. The copying position is selected on the basis of the original-size detection signal 102 produced from the original-size detection means 18 (FIG. 2) as already described above.

The scanning optical system 21 (FIG. 1) is initially positioned at the home position, and the home-position signal 114 is being produced from the home-position sensor 52.

Figure 15:
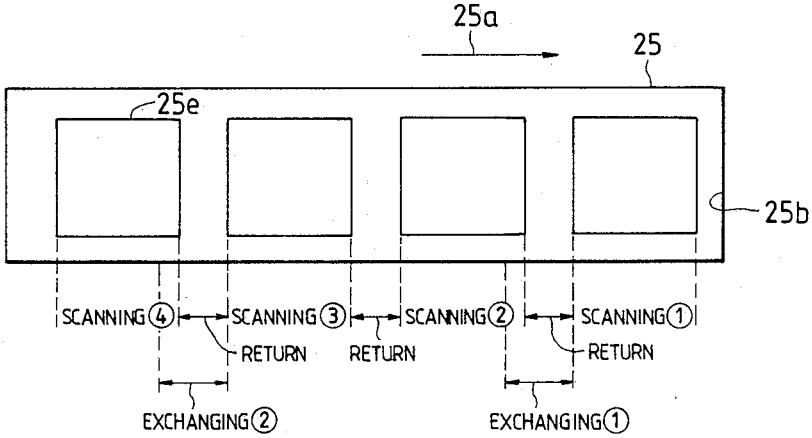

When the original 1*b* has been set at the copying position shown in FIG. 6 and if copying of the original 1*b* is started, the scanning optical system is caused to once scan the glass surface 20 substantially from its left end to its right end so as to carry out exposure for the first copying. At this time, the B registration signal 115 produced from the B-registration sensor 54 is used in order to provide the timing for putting out the exposing signal 113 (FIG. 1). In the case where the original 1*b* is replaced by a second original, the scanning optical system 21 (FIG. 1) returns again to the home position where the home-position sensor 52 is provided. In the case where the same original is to be used as it is for providing continuous copies, for example, the scanning optical system 21 reciprocates repeatedly within the range determined through calculation in advance as shown by the arrow 3. The number of latent images on the photosensitive element 25 (FIG. 1) in this case is twice as large as in the case of FIG. 14 as shown in FIG. 15. The scanning signal 111 (FIG. 1) is being produced while the scanning optical system is scanning in the direction shown by an arrow 3*a* in FIG. 6, and the return signal 112 (FIG. 1) is being produced while the scanning optical system is returning in the direction shown by an arrow 3*b* in the drawing.

Compared with FIG. 5, FIG. 6 is different in that the distance along which the original 1*b* is conveyed in FIG. 6 is shorter than the distance along which the original 1*a* is conveyed in FIG. 5, so that the time of conveyance of the original in the former is shortened. Accordingly, even in the case where original exchange is carried out, four electrostatic latent images can be allotted on the photosensitive element 25 as shown in FIG. 15. A detailed description will be given later.

Figure 7:
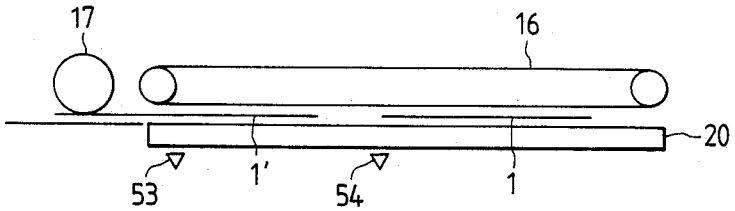
FIG. 7 is an explanatory view showing the method of discharging an original in accordance with the present invention.

If copying an original 1' has been completed and then another original 1 conveyed to a substantially central portion of the glass surface 20 as shown in FIG. 7, the operation of the conveying belt 16 is stopped, so that the original 1' to be discharged still partly remains on the glass surface. As shown in FIG. 7, however, the previously copied original 1' is caught at its forward end by the original discharging rollers 17 so that the original 1' is forcibly discharged from the lower part of the conveying belt 16. Accordingly, no problems develop with the original 1' remaining under the conveying belt 16 to cause interference.

Figure 8:
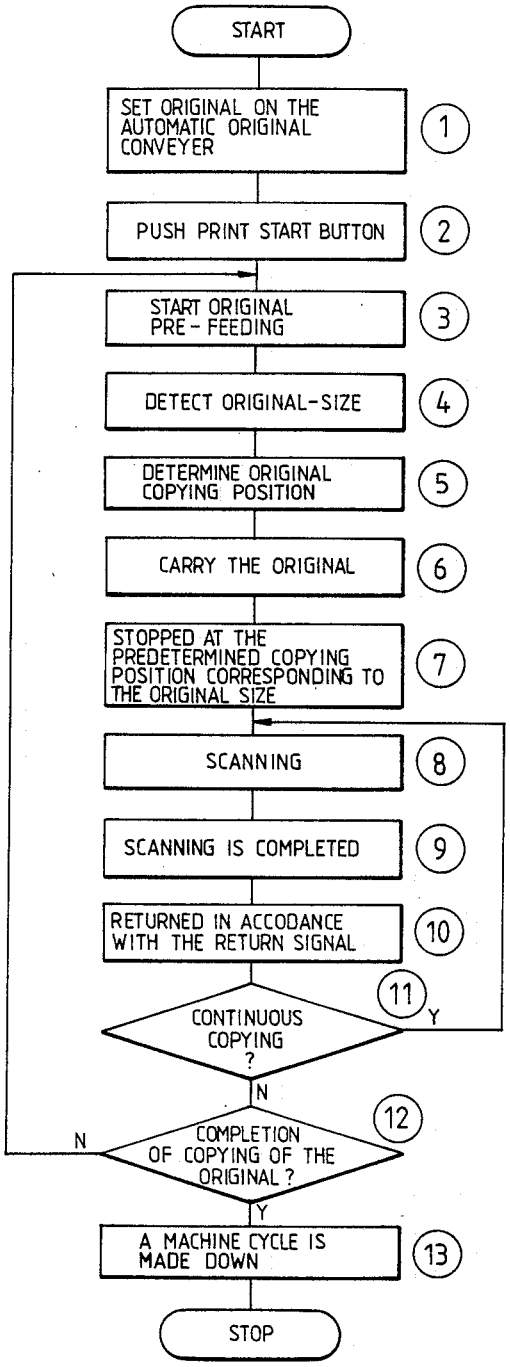
FIG. 8 is a flowchart explaining the operation of the copying apparatus according to the present invention.

Referring to the flowchart of FIG. 8, the operation of copying apparatus according to the present invention will be briefly described.

First, an original is set in the automatic original conveyer 10 (FIG. 1) (step 1). Next, a not shown print start button is pushed by an operator (step 2). The print start signal 121 (FIGS. 3 and 4) is sent from the copying apparatus to the automatic original conveyer through the I/O interfaces 67 and 77. Then, the original-feed start signal 101 and the original pre-feed signal 103 are produced from the automatic original conveyer 10 so as to start original pre-feeding (step 3). The size of the original is detected by the original-size detection means 19 (step 4). An original copying position, as determined by the CPU (FIG. 3) in accordance with the original-size registration signal 105 (FIG. 2), is produced and the gate 15 is opened in accordance with the original-gate opening signal 106. The conveying belt 16 is driven in accordance with the original feed signal 104 so as to carry the original (step 6). The original is then stopped at the predetermined copying position corresponding to the original size (step 7).

Next, the scanning optical systems 21 and 22 (FIG. 1) start scanning the original in accordance with the scanning signal 111 (step 8), and the scanning is completed (step 9). Then, the scanning optical systems 21 and 22 are returned in accordance with the return signal 112 (step 10). In the case of multiple copying, the scanning optical systems 21 and 22 scan the original again in accordance with the scanning signal 111 (steps 11 and 8). At that time, the exposing signal 113 and the paper-feed signal 119 are produced at a predetermined timing in accordance with the B-registration signal 115 and the A-registration signal 116 respectively.

Upon completion of copying of the original, the existence of another original is judged (step 12), and if another original exists, the operation is returned to the pre-feeding step for the original (step 3). The original exchange is carried out here. If no other original is detected, on the contrary, the machine cycles down (step 13) to finish the copying operation.

In the apparatus according to the present invention arranged to operate in such a manner as described above, the conveying distance of a smaller-size original is reduced. The time taken to exchange originals is thereby reduced accordingly, resulting in an improvement in productivity. The improvement will be described with reference to the timechart shown in FIG. 9.

The timechart shows the case where an original having a size 210 mm in total length is conveyed onto a glass surface having a length of 420 mm at a conveying speed of 1000 mm/sec.

Figure 9:
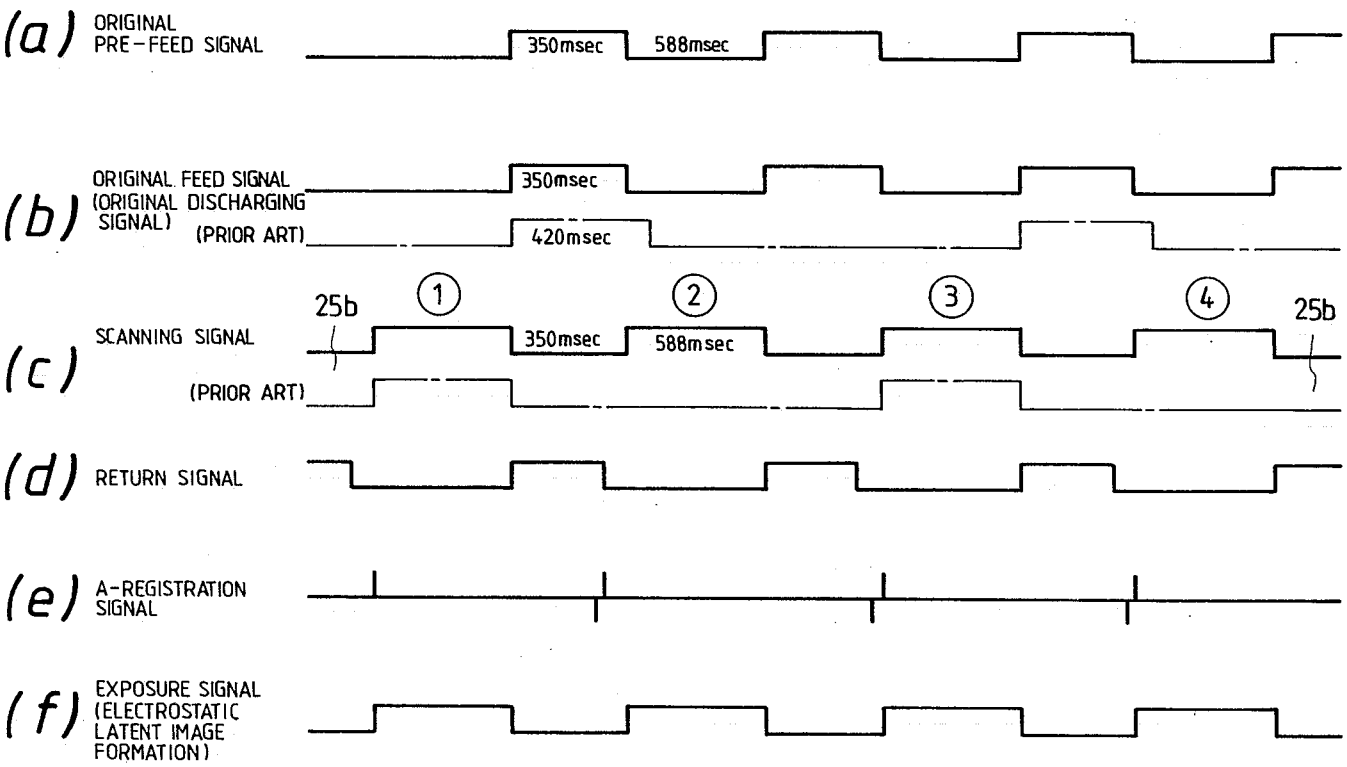
FIG. 9 is a time chart for explaining the operation of the copying apparatus according to the present invention.
Figure 10:
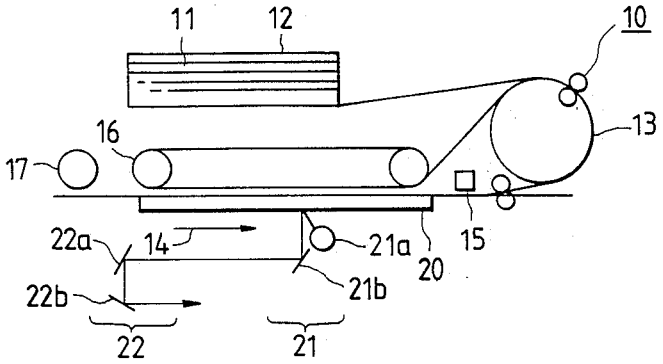
FIG. 10 PRIOR ART
FIG. 10 is a schematic diagram of a conventional automatic original conveyer.
Figure 11:
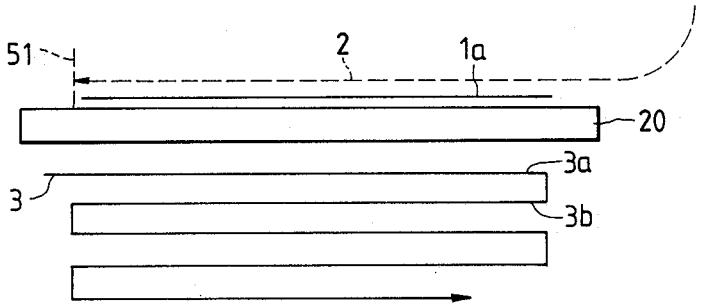
FIG. 11 PRIOR ART
FIGS. 11 and 12 are diagrammatic views explaining the operation of a conventional automatic original conveyer.
Figure 12:
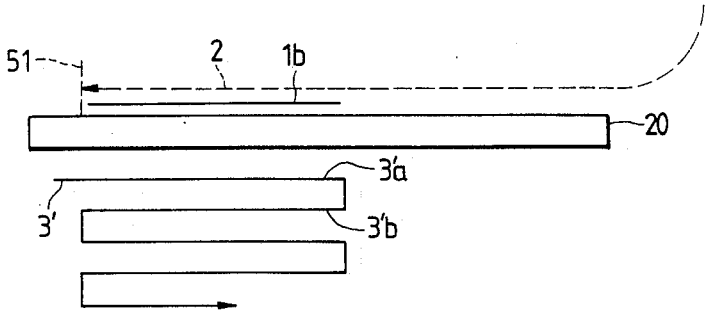
FIG. 12 PRIOR ART

Under the conditions, original pre-feeding is carried out (FIG. 9(*a*)), and a previously pre-fed original is conveyed onto the glass surface while the pre-feeding is being carried out (FIG. 9(*b*)). The original placed on the glass surface is scanned by the optical systems immediately upon completion of conveyance of the original (FIG. 9(*c*), and the optical systems are returned after completion of scanning (FIG. 9(*d*)). Upon start of scanning by the scanning systems and just before completion of the scanning system return, the A-registration sensor detects passage of the scanning system to generate the A-registration signal (FIG. 9(*e*). Exposure is started synchronous with the A-registration signal (FIG. 9(*f*)).

Both the time for original pre-feeding and the time for original conveyance is selected to be 350 msec. The original conveyance is carried out only while the scanning systems are not scanning.

The optical systems start to return just after completion of scanning. The time for returning is selected to be slightly shorter than 350 msec, and the time for exposure is selected to be substantially the same as the time for scanning by the scanning optical systems.

If the scanning time is selected to be 588 msec and the time from completion of a scanning to start of a succeeding scanning is selected to be 350 msec as shown in FIG. 9(*c*), four electrostatic latent images 25*e* can be allotted on the photosensitive element 25 as shown in FIG. 15.

By contrast, in a step 1 in FIG. 9(*c*), according to the prior art method, original exchange is carried out in 420 msec, as shown by one-dotted line in FIG. 9(*b*), after exposure has been carried out for 588 msec. In the prior art, due to the exchange taking such a long time, the problems discussed earlier occur. That is, in spite of four exposure steps 1 through 4 between seam portions 25*b* shown in FIG. 9(*c*) at its opposite ends, exposure is practically carried out only twice. The state is shown by a one-dotted line in FIG. 9(*c*).

On the other hand, according to the present invention, the original exchange is completed in 350 msec, so that even if original exchange and exposure are carried out alternately, electrostatic latent images can be formed at the timing shown by a solid line in FIG. 9(*c*). That is, with the allotment of electrostatic image formation as shown in FIG. 15, copying can be carried out at a high speed the same as in continuous copying.

Therefore, according to the present invention, the productivity can be improved to twice that of the conventional method.

In the foregoing copying apparatus according to the present invention, in the case of an original having a small size, the copying position is changed so as to shorten the distance of conveying the original, resulting in improvement in productivity. In that case, the more frequently the original exchange is carried out, the more remarkable the effect in improvement is in comparison with the conventional apparatus.

Additional advantages and modifications will readily occur to those skilled in the art. The invention in the broader aspects is, therefore, not limited to the specific details, representative apparatus and illustrative example shown and described. Accordingly, departures may be made from such details without departing from the spirit or scope of applicant's inventive concept, and the scope of the invention is limited only by the appended claims and their equivalents.

What is claimed is:

1. A copying apparatus for copying a first and second original document, said apparatus comprising:

detecting means for detecting a size of an original document detected;

a glass copying surface having a plurality of predetermined copying positions;

position selection means for selecting one predetermined copying position on the glass copying surface in accordance with the size of an original document detected by said detecting means;

conveying means for feeding the first original document to the selected predetermined copying position at a first time, and conveying the first original document a predetermined distance past the selected predetermined copying position at a second time, while feeding the second original document to the selected predetermined copy position, said predetermined distance corresponding to the size of the first original document;

copying means for selectively performing full-scanning, half-scanning, and multiple scanning by transferring an image of the original document at the selected predetermined copying position onto a photographic element;

control means for setting a scanning region of the copying means corresponding to the selected predetermined copying position and driving said copying means in said scanning region; and discharge assist means for removing the first original document from the glass copying surface at times when the predetermined distance is insufficient for the first original document to clear the glass copying surface.

2. The copying apparatus according to claim 1, wherein said original conveyor means comprises multiple sets of rollers and gates to convey an original from a tray to a glass surface or single or continuous copying in accordance with a series of control signals.

3. The copying apparatus according to claim 1, wherein said size detection means obtain the length of the original as a function of the amount of time for the passage of an original past said detection means.

4. The copying apparatus according to claim 1, wherein said copying means is comprised of a scanning optical system and a photographic element which act in accordance with a size detection signal and a series of control signals.

5. The copying apparatus according to claim 1, wherein an original conveying distance, as determined by a control signal generated by said size-detection means, is shortened when the size of the original is small, so as to correspondingly shorten an original exchange time.

6. The apparatus of claim 1, wherein said discharge assist means comprise opposing rollers disposed to nip the first original document and remove the first original document from the glass copying surface.

7. A copying apparatus for copying a first and second original document, said apparatus comprising:

detecting means for detecting a size of the first and second original documents;

a glass copying surface having a plurality of predetermined copying positions;

position selection means for selecting one predetermined copying position on the glass copying surface in accordance with the size of the first and second original documents by said detecting means;

conveying means for feeding the first original document to the selected predetermined copying position at a first time, and conveying the first original document a predetermined distance past the selected predetermined copying position at a second time, while feeding the second original document to the selected predetermined copying position, said predetermined distance corresponding to the size of the first original document;

copying means for selectively performing full-scanning half, scanning, and multiple scanning by transferring an image of the original document at the selected predetermined copying position onto a photographic element, said photographic element comprising an endless belt having a seam portion, the transferred image being formed on a portion of the photographic element other than the seam portion in a plurality of patterns corresponding to the type of scanning performed;

control means for setting a scanning region of the copying means corresponding to the selected predetermined copying position and driving said copying means in said scanning region; and discharge assist means for removing the first original document from the glass copying surface at times when the predetermined distance is insufficient for the first original document to clear the glass copying surface.

* * * * *

UNITED STATES PATENT AND TRADEMARK OFFICE

CERTIFICATE OF CORRECTION

PATENT NO. : 4,967,232

DATED : October 30, 1990

INVENTOR(S) : Tsuneo Obara

It is certified that error appears in the above-identified patent and that said Letters Patent is hereby corrected as shown below:

Claim 1, column 12, line 20, delete "detected"

Signed and Sealed this

Nineteenth Day of January, 1993

*Attest:*

DOUGLAS B. COMER

*Attesting Officer*

*Acting Commissioner of Patents and Trademarks*